United States Patent [19]

Sobel

[11] 4,322,590

[45] Mar. 30, 1982

[54] PNEUMATIC REMOTE SENSING APPARATUS

[76] Inventor: Martin Sobel, R.D. 8, Floral Rd., Flemington, N.J. 08822

[21] Appl. No.: 87,043

[22] Filed: Oct. 22, 1979

[51] Int. Cl.[3] ..... H01H 35/40

[52] U.S. Cl. ..... 200/81.9 R; 200/81.4; 340/608; 73/37.7; 137/596.14

[58] Field of Search ..... 137/502, 595, 596.14; 73/37, 37.5, 37.6, 37.7; 340/606, 608, 610; 200/81 H, 81.4, 81.5, 81 R, 81.9 R, 83 R, 83 N, 61.13, 61.15

[56] References Cited

U.S. PATENT DOCUMENTS

| | | | |
|---|---|---|---|
| 2,791,657 | 5/1957 | Bloxom | 200/81.9 R |
| 2,841,667 | 7/1958 | Stowe | 200/81.9 R |
| 3,341,099 | 9/1967 | Jacobsen | 200/81.9 R |
| 3,509,898 | 5/1970 | Monge | 200/DIG. 5 |
| 3,510,616 | 5/1970 | DiNola | 200/83 R |
| 3,739,190 | 6/1973 | Whitsel | 200/81.9 R |
| 3,760,396 | 9/1973 | Haselton | 200/83 N |
| 3,769,475 | 10/1973 | Czwakiel | 73/37.7 |
| 4,088,011 | 5/1978 | Bodine | 200/83 N |
| 4,118,612 | 10/1978 | Gabus | 200/81.9 R |
| 4,119,865 | 10/1978 | Elderton | 200/81 R |

*Primary Examiner*—Gerald P. Tolin
*Attorney, Agent, or Firm*—Vogt & O'Donnell

[57] ABSTRACT

A pneumatic remote sensing device having a passageway, a connecting tube connected to the downstream end of the passageway, and blockage means for preventing or permitting the escape of gas from the downstream end of the connecting tube. The passageway includes a venturi section, and means for detecting the pressure within the venturi section and producing an output signal dependent on that pressure are provided. Gas under a supply pressure can be introduced at the upstream end of the passageway. Thus, so long as the blockage means are open, the gas can flow through the passageway and the connecting tube, and the pressure within the venturi section of the passageway will remain low. However, when the blockage means close and prevent the escape of gas from the downstream end of the connecting tube, the pressure in the venturi section rises rapidly and the detector means produces an output signal indicative of the closure of the blockage means almost instantaneously after such closure occurs. The device is relatively insensitive to changes in gas supply pressure, and can accommodate an extremely wide range of connecting tube lengths without any adjustment.

11 Claims, 5 Drawing Figures

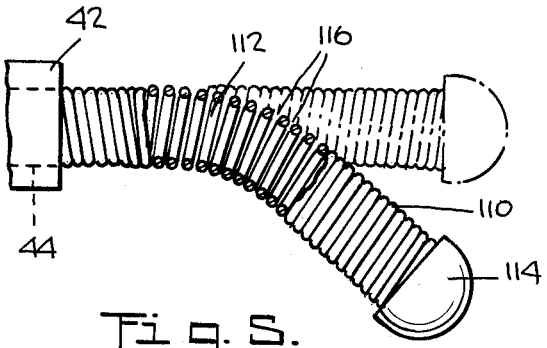
Fig. 5.
Fig. 1.
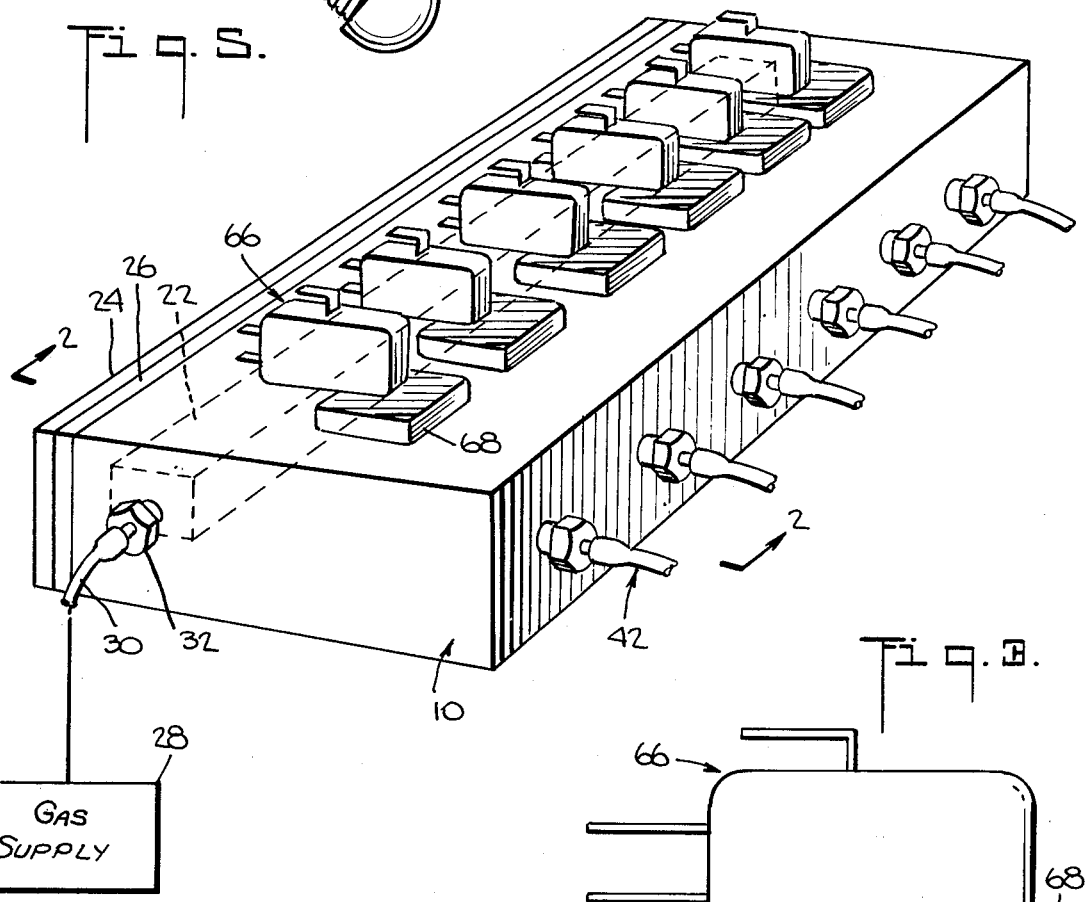
Fig. 3.
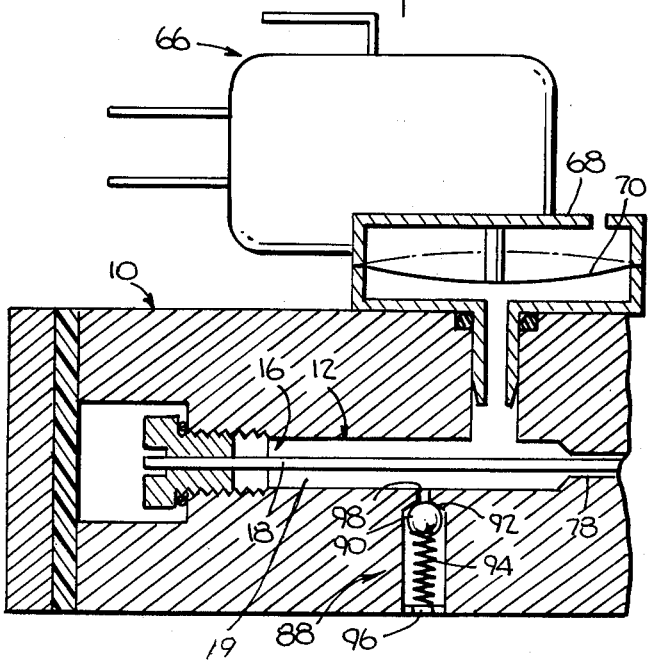
Fig. 4.
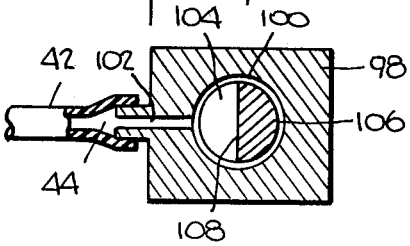

PNEUMATIC REMOTE SENSING APPARATUS

BACKGROUND OF THE INVENTION

This invention relates to the art of pneumatic control equipment, and more particularly relates to a pneumatic device for detecting a phenomenon at one location and producing an output signal at another location indicative of the phenomenon so detected.

Such remote sensing apparatus is used in numerous applications in industrial machinery and the like. For example, in complex automatic machinery having a multitude of reciprocating slides, the presence of a particular slide at the end of its stroke must be detected at a location adjacent to that slide, while the output signal produced in response to such presence must be produced at a central control panel several feet away from that slide.

In this disclosure, the term "signal" is used in its broadest sense and is not limited to active, energetic outputs. Rather, the term "signal" should be understood as also including any status of a mechanical, pneumatic, hydraulic, fluidic or electrical element which can be detected by a further device or which can be detected manually. Thus, for example, the closed status of an electrical switch would constitute a signal, and the open status of the same switch would constitute another, different signal.

Although various electrical and hydraulic arrangements can be utilized for remote sensing, considerations of cost, simplicity of operation, ease of maintainence and safety often favor the use of a pneumatic remote sensing system. Any such system should possess the following desirable characteristics. First, it should produce the appropriate signal immediately upon the occurrence of the phenomenon to be sensed, with the least possible delay. Second, it should requite only a single pneumatic conduit extending between the location where the phenomenon is to be sensed and the location where the output signal is to be produced, so that the system does not unnecessarily encumber the equipment on which it is mounted. Third, it should not require any careful adjustment during installation or use, and should be capable of accomodating substantial variations among installations in the distance between the sensing location and the location where the output signal is to be produced. Fourth, it should be reliable; it should always produce the output signal representative of a phenomenon which has occurred, and it should never produce a false output signal which is representative of a phenomenon which has not occurred.

One remote sensing system is described in U.S. Pat. No. 4,118,612, issued Oct. 3, 1978. In this system, the upstream end of a tubular conduit is connected to a source of compressed air by way of an adjustable throttling valve, and a normally-open pressure sensitive switch is connected to the conduit adjacent to its upstream end. The downstream end of the conduit can be occluded by the operator's finger. Thus, while the downstream end of the conduit is not occluded, air will flow through the throttle valve and the conduit and out through the downstream end of the conduit through the atmosphere. During such operation, the pressure in the conduit at the pressure-sensitive switch will depend on the supply pressure, the throttle valve setting and the flow resistance of the conduit itself. All of these factors must be chosen and maintained so that this pressure is less than the so-called trip pressure required to close the pressure sensitive switch. When the downstream end of the conduit is occluded, continued flow of air into the conduit through the throttle valve causes the pressure within the conduit to rise gradually until it reaches the supply pressure. At some time during this process, the pressure in the conduit reaches the trip pressure and the switch closes, thus producing an output signal indicating presence of the operator's finger. The delay between occlusion of the conduit and closure of the switch is roughly proportional to the difference between the trip pressure and the pressure at the switch during operation while the conduit is not occluded.

While this system is capable of satisfying some of the aforementioned requirements, it cannot satisfy all of them simultaneously. If the supply pressure, the throttle valve setting and the flow resistance of the conduit are chosen and balanced so that the aforementioned pressure difference is small, then the switch will close promptly after the downstream end of the conduit is occluded. However, any small change in the supply pressure or in the flow resistance of the conduit will raise the pressure at the switch above the trip pressure, and will thus cause a false trip to occur while the downstream end of the conduit is not occluded. On the other hand, if the difference is great, the system will be relatively safe from accidental trips, but the delay between occlusion of the conduit and closure of the switch will be substantial.

SUMMARY OF THE INVENTION

It is an object of the present invention to provide a pneumatic remote sensing device which is capable of meeting all of the aforementioned requirements. In particular, it is an object of the present invention to provide a pneumatic remote sensing system which is capable of reliably producing an output signal representative of the phenomenon to be sensed promptly upon its occurence but which will not accidently produce that output signal in the absence of such occurence.

The device of the present invention includes a connecting tube which defines a connecting tube bore and a structure defining a passageway. The downstream end of the passageway communicates with the upstream end of the connecting tube bore. The upstream end of the passageway is constructed and arranged to receive a gas under a supply pressure. Blockage means are provided at the downstream end of the connecting tube bore for selectively substantially preventing or permitting the escape of gas from the downstream end of the connecting tube bore in response to the phenomenon to be sensed. Thus, while the blockage means permits such escape, gas received at the upstream end can flow through the passageways through the connecting tube bore and out through the downstream end of the connecting tube bore. The passageway includes a venturi section, and the passageway is constructed and arranged to confine any gas which flows through it from its upstream end to its downstream end into a constricted stream which has a cross-sectional area substantially less than the cross-sectional area of the connecting tube bore. The passageway is constructed so that such gas is confined into such constricted stream throughout the upstream-to-downstream extent of the venturi section. Detector means are provided for detecting the pressure within the venturi section and producing an output signal which is a function of that pressure. That is, the detector means produce an output signal which varies in response to the pressure in the venturi section. In the preferred embodiment, this variance is discontinuous, so that the detector means produces one output signal whenever the pressure in the venturi section is less than a predetermined trip pressure, and another output signal whenever the pressure in the venturi section is greater than such predetermined trip pressure.

The aforementioned arrangement provides a device which is substantially insensitive to variations in supply pressure, which can produce the output signal indicative of the phenomenon which is sensed by closure of the blockage means almost instantaneously upon the occurence of such phenomenon and such closure, but which is almost immune to accidental production of that output signal in the absence of such phenomenon.

It is believed that the desireable characteristics of the device of the present invention result from the Bernoulli effect in the venturi section. During operation with the blockage means open, the gas flowing in the constricted stream within the venturi section must have a greater velocity than the gas flowing in the connecting tube bore. Due to the Bernoulli effect, the pressure in the venturi section is reduced by an amount which increases with the rate of gas flow. Any increase in the supply pressure will increase the rate of gas flow, and will therefore increase the reduction in pressure caused by the Bernoulli effect. Thus, the pressure within the venturi section does not increase directly with the supply pressure.

It is also believed that, due to the Bernoulli effect, the pressure in the venturi section during operation with the blockage means open is substantially less than the pressure at the upstream end of the connecting tube bore. Thus, the device can be operated with an extremely high flowrate into and through the connecting tube bore, and with a relatively high pressure at the upstream end of the connecting tube bore, without causing a high pressure in the venturi section. When the phenomenon to be sensed by closure of the blockage means occurs and the flow of gas through the downstream end of the connecting tube bore is stopped, the rapid flowrate into the connecting tube continues and causes the pressure within the connecting tube to rise extremely rapidly, until it is equal to the supply pressure and the flow ceases. At the same time, the reduction in pressure within the venturi section caused by the Bernoulli effect disappears. Thus, the pressure within the venturi section rises almost instantaneously when the flow through the connecting tube is stopped by closure of the blockage means, and the output signal indicative of the phenomenon to be sensed by such closure is produced almost instantaneously.

These and other objects, features and advantages of the present invention will be better understood with reference to the following detailed description of the preferred embodiments and the accompanying drawings.

BRIEF DESCRIPTION OF THE DRAWINGS

FIG. 1 is a perspective view depicting part of one device according to a first embodiment of the present invention, along with like parts of additional devices according to the same embodiment.

FIG. 3 is a fragmentary sectional view depicting a portion of a device according to a second embodiment of the present invention.

FIGS. 4 and 5 are fragmentary, partially sectional views depicting blockage means utilized in additional embodiments of the present invention.

DETAILED DESCRIPTION OF THE PREFERRED EMBODIMENTS

Figure 2:
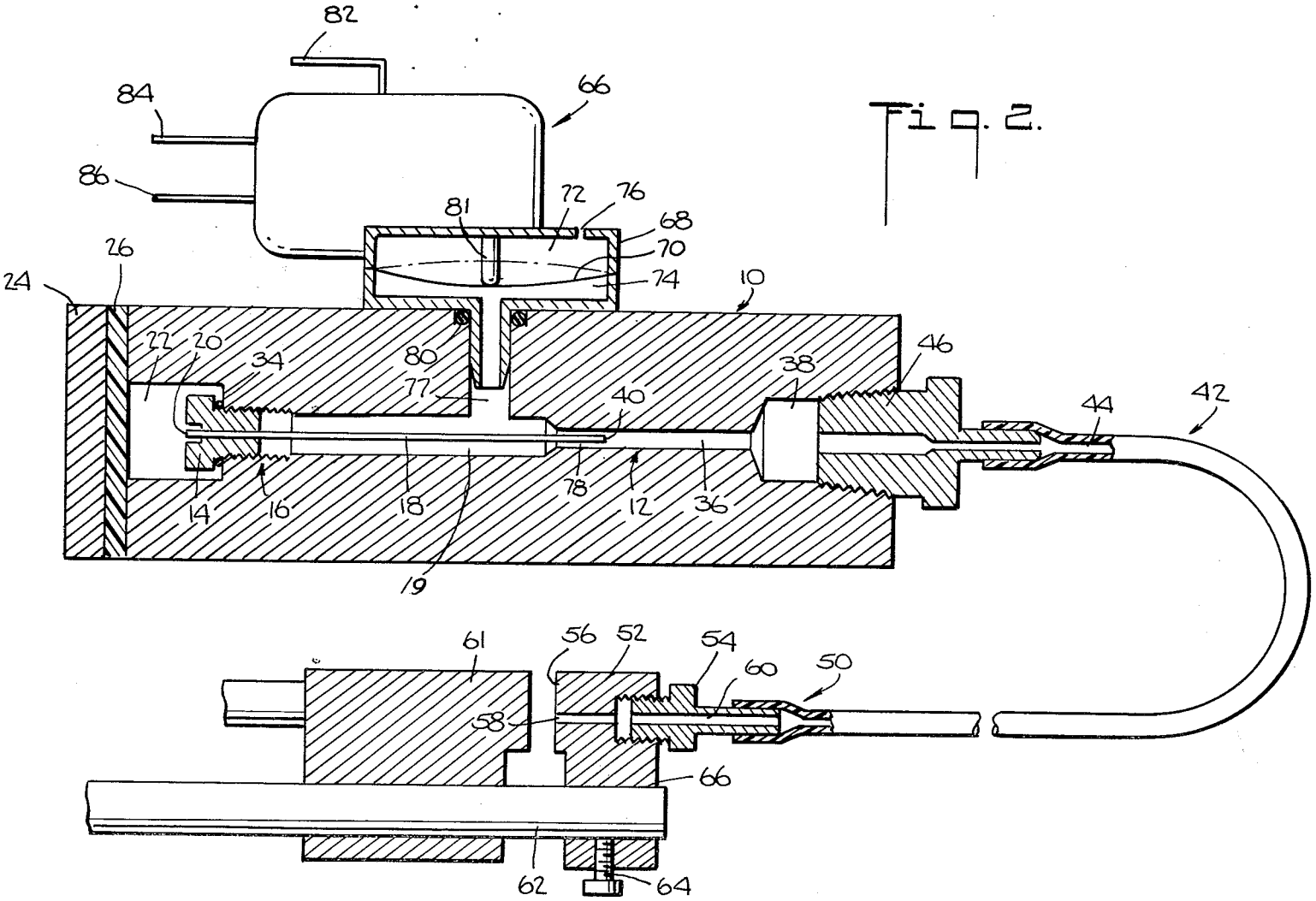
FIG. 2 is a sectional view, partially taken along line 2—2 in FIG. 1, depicting a device according to the first embodiment of the present invention in its entirety.

As depicted in FIG. 2, a device according to a first embodiment of the present invention includes a block 10 which has a block bore 12 extending through it. A plug 14 is mounted in the upstream end 16 of the block bore by means of mating screw threads on the plug and in the upstream end of the block bore. A hollow tubular cannula 18 extends through the plug 14 and is affixed thereto. The plug, cannula and block bore are arranged so that the cannula extends substantially coaxially with the block bore and an upstream portion of the block bore forms a chamber 19 surrounding the cannula. The upstream end 20 of the hollow cannula is open to a slot 22 which extends within the block generally perpendicularly to the block bore. A cover plate 24 and a gasket 26 cover the open side of the slot. As depicted in FIG. 1, the slot can be connected to a gas supply 28 by a tube 30 and a fitting 32. Thus, the open end 20 of the cannula can receive gas under a supply pressure created by the gas supply 28 by way of the tube, fitting and slot. To prevent any gas from entering the block bore around the outside of the plug 14, an O-ring 34 (FIG. 2) sealingly engages the block and the plug. The exterior of the cannula is sealed to the plug.

As can be appreciated, the cannula 18 and the portion 36 of the block bore 12 which extends downstream of the cannula cooperatively define a continuous passageway extending from the upstream end 20 of the cannula to the downstream end 38 of the block bore. Any gas flowing from the upstream end of this passageway to the downstream end of it must pass through the cannula before entering the block bore. As the gas passes through the cannula, it is, of course, confined into a constricted stream having a cross-sectional area no greater than the cross-sectional area of the cannula. The gas will issue from the downstream end 40 of the cannula in such a constricted stream, and will retain this form for at least some distance downstream of the downstream end of the cannula. Thus, the venturi section of the passageway, over which the gas is confined in a constricted stream by the action of the cannula, includes the entire interior of the cannula and the portion of the block bore immediately downstream of the cannula.

A connecting tube 42 having a connecting tube bore 44 is affixed to the block 10 by a fitting 46 so that the downstream end of the passageway (the downstream end 38 of the block bore) communicates with the upstream end of the connecting tube bore 44.

The downstream end 50 of the connecting tube is affixed to a sensor block 52 by a fitting 54. The sensor block 52 has an exposed surface 56 and an orifice 58 open to that exposed surface. The orifice 58 is in communication with the downstream end of the connecting tube bore 44 by way of a hole 60 in fitting 54, so that the orifice 58 forms a downstream continuation of the connecting tube bore 44.

The device depicted in FIG. 2 is intended to detect the presence of one element of a machine at the end of its predetermined path of travel with respect to another element of the same machine. A portion of a typical machine is depicted in FIG. 2. The first or movable element 61 of this machine is slidably mounted on a rail 62 which constitutes the second or fixed element of the machine.

The sensor block 52 is provided with a setscrew 64 and mounting pocket 66 which engage the fixed element 62 of the machine and affix the sensor block to the fixed element so that the exposed surface 56 of the sensor block extends across the path of travel of the movable element 61.

As will be readily appreciated with reference to FIG. 2, when the movable element 61 is at the extreme right-hand end of its stroke, the exposed surface 56 of the sensor block will abut the movable element and will arrest its travel. At that time, the movable element of the machine will occlude the orifice 58 and will thus substantially prevent the flow of gas out from the downstream end of the connecting tube bore 44. Thus, at that time, the pressure within the venturi section of the passageway will suddenly rise. Because the orifice 58 and the exposed surface 56 are both formed as integral features of the sensor block 52, they cannot move with respect to one another. Therefore, the occlusion of the orifice will always be precisely synchronized with the engagement of the movable machine element by the exposed surface. This synchronization cannot be destroyed by misadjustment. Such precise synchronization is an important advantage of this embodiment of the present invention.

As described above, the venturi section of the passageway within the block 10 includes the portion of the block bore 12 immediately downstream of the cannula 18. A transducer or detector means for detecting the pressure in the venturi section includes an electrical switch 66 and a hollow chamber 68 affixed to the block 10. A flexible diaphragm 70 is mounted within the chamber and subdivides the space within the chamber into two portions 72 and 74. One such portion 72 is in communication with the atmosphere by way of a vent hole 76 in the wall of the chamber, while the other one 74 of such portions is in communication with the venturi section of the passageway by way of a cross bore 77 in the block 10 and the chamber 19 defined by the portion of the block bore which surrounds the cannula 18. As will be appreciated, the chamber 19 is in communication with the venturi section of the passageway at the downstream end of the cannula. A seal 80 is provided at the juncture of the cross bore 77 with the chamber 68. Thus, the portion 74 of the chamber can communicate only with the venturi section of the passageway, and the pressure within this portion 74 of chamber 68 will be equal to the pressure within the venturi section of the passageway.

The electrical switch 66 includes a movable contact 81 and three fixed contacts 82, 84 and 86. The movable contact 81 of the electrical switch is baised against the diaphragm 70 by a spring (not shown), so that the movable contact is operatively connected to the diaphragm for movement therewith. Whenever the pressure within the chamber portion 74 is less than a predetermined trip pressure, the movable contact 81 will electrically connect fixed contact 82 to fixed contact 84. Whenever the pressure in the chamber portion 74 is greater than a predetermined trip pressure, the diaphragm 70 will deflect to the position depicted in broken lines in FIG. 2, and the movable contact 81 will then electrically connect fixed contact 82 to fixed contact 86. Thus, the detector means will produce one output signal whenever the pressure in the venturi section of the passageway is less than the trip pressure, and will produce another, different output signal whenever the pressure in the venturi section of the passageway is greater than the trip pressure. Of course, the magnitude of the trip pressure will depend on the construction of the diaphragm and the electrical switch.

The operation of the device is simple. So long as gas under pressure is supplied to the upstream end of the cannula 20 and the orifice 58 is not occluded by the movable machine element 61, gas will flow through the passageway and through the connecting tube bore 44. Because of the venturi action, the pressure in the venturi section of the passageway will remain less than the trip pressure, even if the gas supply pressure at the upstream end of the cannula increases substantially. Therefore, contact 82 will remain electrically connected to contact 84 for so long as this condition persists.

However, when the movable machine element 61 abuts the face 56 of the sensor block 52, the flow of gas out from the downstream end of the connecting tube bore is substantially prevented, and the pressure in the venturi section of the passageway rises almost instantaneously until it becomes equal to the supply pressure. Provided that the supply pressure is greater than the trip pressure, the pressure in the venturi section of the passageway, and hence in the chamber portion 74, will become greater than the trip pressure at this time. Contact 86 will be connected to contact 82, while contact 84 will be disconnected from contact 82. This change in electrical connection can be detected by any of the many well-known forms of electrical circuitry used in automatic equipment, and can thus be used to trigger other appropriate actions.

Although numerous configurations are possible, in one suitable configuration of the device depicted in FIG. 2, the cannula is formed from stainless steel and has a cylindrical interior bore of 0.024" diameter. The outside diameter of the cannula is 0.036", and the portion 36 of the block bore surrounding the downstream end of the cannula is cylindrical, with a 0.052" diameter. The trip pressure of the diaphragm and switch assembly is about 2 in $H_2O$, while the supply pressure may be any pressure between about 1 pound per square inch and about 5 pounds per square inch. If the connecting tube is circular in cross-section, its interior diameter can be between about 0.125 inches and about 0.250 inches, and its length can be between 0.1 and 96.0 inches. So long as the device is operated within these parameters, it will not produce any accidental trips but will trip, and connect contact 82 to contact 86 within 50 milliseconds after the downstream end of the connecting tube bore is occluded by the blockage means.

As will be appreciated, the wide operating range of the device of the present invention eliminates the need for any individually controllable throttling valve on each device and for individual adjustment of the supply pressure to each device. Thus, as depicted in FIG. 1, a plurality of these devices, which can operate independently to sense a plurality of independent phenomena, can be connected directly to a single manifold without any intervening pressure or flow regulating devices. In the apparatus depicted in FIG. 1, the common manifold is the slot 22 which is formed in the block 10. Each of the devices is identical with the device depicted in FIG. 2. The upstream end 20 of the cannula of each of these devices is in direct communication with the slot. That is, there is no intervening pressure or flow control device between the slot and the upstream end of each cannula.

As will be appreciated, the insensitivity of each device of the present invention to variations in its supply pressure allows several devices to be "ganged" in this manner but still operate independently to sense independent phenomena. If the blockage means of one device is closed, the gas flow through that device will cease. This may, in turn, cause the pressure in the manifold to rise somewhat, but such a rise will not cause the other devices to produce a "false trip."

Because the devices of the present invention can be "ganged" in this manner, it is practical to prefabricate a component comprising the manifold, the passageways and the transducers.

Such component can be utilized in the construction of a system for sensing a plurality of independent phenomena by connecting the manifold to a source of gas under pressure, connecting the downstream end of each passageway to an appropriate connecting tube and blockage means, and connecting each transducer to appropriate components which are arranged to respond to the output signal produced by that transducer. Of course, if the number of phenomena to be sensed is less than the number of passageways provided in the component, any unused passageways can be plugged at their respective downstream ends. The simplicity of installation attained through the use of such a prefabricated component is an important advantage of the present invention.

As described above, the devices depicted in FIGS. 1 and 2 will respond rapidly to the phenomenon to be sensed by closure of the blockage means, because the pressure in the venturi section will rapidly rise when flow through the downstream end of the connecting tube bore is prevented. However, they may not respond quite as rapidly to the phenomenon to be sensed by opening of the blockage means and restoration of flow through the downstream end of the connecting tube bore. If the pressure in the venturi section has increased, while the flow through the connecting tube bore was prevented, until the pressure in the venturi section is equal to the supply pressure, then such pressure will be substantially greater than the trip pressure. When flow through the connecting tube is restored, it will require some time for the pressure in the venturi section to fall below the trip pressure.

This time can be minimized by preventing the pressure in the venturi section from ever rising beyond a predetermined relief pressure which is only slightly greater than the trip pressure. In the embodiment depicted in FIG. 3, this is accomplished by a relief valve 88. The relief valve 88 includes a ball 90, a ball seat 92 formed integrally with the block 10, and a compression spring 94 bearing on the ball at one end and on a retainer 96 at the other end. The retainer 96 is affixed to the block so that the compression spring 94 biases the ball 90 against the seat 92. An opening 98 connects the ball seat with the chamber 19 which in turn is connected to the venturi section of the passageway by block bore section 78.

The elements of the relief valve are constructed and arranged so that the ball 90 will move away from the seat 92 whenever the pressure in the passageway exceeds a predetermined relief pressure. The relief pressure is chosen so that it is only slightly higher than the trip pressure. For example, if the trip pressure is 2 in $H_2O$, then the relief pressure should be about 6 in $H_2O$.

The devices described above are adapted to sense the presence of a machine element at a particular location. However, the device of the instant invention can be used to sense any phenomenon, so long as appropriate blockage means for substantially preventing or permitting flow of gas from the downstream end of the connecting tube in response to the phenomenon to be sensed is provided. These will, of course, vary with the application.

One such alternative blockage means is depicted in FIG. 4. This device includes an encoder block 98 having a generally cylindrical shaft mounting bore 100 and an orifice 102 intersecting the shaft mounting bore. A shaft 104 is mounted generally coaxially with the shaft mounting bore for rotation therein. The shaft 104, in the vicinity of the orifice 102, has a generally acurate surface 106 which closely overlies the interior surface of the shaft mounting bore and a cutaway surface 108 which is remote from the interior surface of the shaft mounting bore. The downstream end of the connecting tube 42 is affixed to the encoder block so that the orifice 102 is in communication with the connecting tube bore 44 and forms a downstream continuation thereof. When the shaft rotates to a position wherein the arcuate surface 106 overlies the orifice 102, the orifice will be occluded and flow of gas through the downstream end of the connecting tube bore will be substantially prevented. Continued rotation of the shaft will bring the cutaway surface 108 into alignment with the orifice 102, so that the flow of gas may resume. As will be appreciated, if the shaft is continuously rotated, the device will produce a series of output signals.

As shown in FIG. 5, a simple, closely wound coil spring 110 can also be used as a blockage means. One end of the coil spring is affixed to the downstream end of the connecting tube 42 so that the interior bore 112 defined by the coils of the spring is in communication with the connecting tube bore 44. A plug 114 occludes the opposite end of the bore 112. Thus, when no side loading is applied to the spring, the coils of the spring substantially sealingly abut one another, as depicted in broken lines in FIG. 5, and substantially prevent any flow of gas through the downstream end of the connecting tube bore. By contrast, when a side loading is applied to the spring, the spring bends and adjacent coils of the springs are separated form one another, allowing flow through spaces 116 which appear between the coils.

As will be appreciated, numerous variations and combinations of the features described in the foregoing description of the preferred embodiments can be utilized without departing from the spirit of the present invention as defined in the appended claims.

Merely by way of example, any of the numerous pressure transducers known to those skilled in the art can be utilized in place of the diaphragm and switch combination described above. Thus, if an electrical output signal is desired, piezoelectric, strain gauge or magnetostrictive transducers could be used. If a visually-detectable output signal is desired, a mechanical transducer such as a Bourdon tube pressure gauge could be utilized. To produce a pneumatic output signal, a pilot-operated valve could be utilized as a pressure transducer. Of course, regardless of which type of pressure transducer is chosen, it is essential that the pressure transducer be arranged to sense the pressure within the venturi section of the passageway.

I claim:

1. A pneumatic remote sensing device comprising:

(a) a connecting tube defining a connecting tube bore having an upstream end and a downstream end;

(b) a structure defining a passageway having an upstream end, a downstream end and a venturi section between its upstream and downstream ends, the downstream end of said passageway communicating with the upstream end of said connecting tube bore;

(c) means for connecting the upstream end of said passageway to a source of gas under pressure whereby gas received in said passageway from such source may flow downstream in said passageway and said connecting tube bore;

(d) means for confining any gas flowing downstream in said passageway into a constricted stream of cross-sectional area substantially less than the cross-sectional area of said connecting tube bore so that the constricted stream extends through said venturi section;

(e) blockage means for substantially preventing or permitting the escape of gas from the downstream end of said connecting tube bore in response to the phenomenon to be sensed;

(f) detector means for detecting the pressure within said venturi section of said passageway, producing a first output signal when such pressure is less than a predetermined trip pressure and producing a second output signal, different from said first output signal when the pressure within said venturi section is greater than said trip pressure; and (g) a relief valve in communication with said passageway, said relief valve opening and releasing gas from said passageway when, and only when, the pressure within said passageway exceeds a predetermined relief pressure, said relief pressure being greater than said trip pressure.

2. A device as claimed in claim 1, wherein said detector means includes a hollow housing, a flexible diaphragm mounted within said housing and subdividing the interior of said housing into two parts, one such part being in communication with said venturi section of said passageway, the other such part being open to the atmosphere, said detector means also including an electrical switch having a fixed contact and a movable contact, the movable contact of said switch being operatively connected to said flexible diaphragm.

3. A pneumatic remote sensing device comprising:

(a) a connecting tube defining a connecting tube bore having an upstream end and a downstream end;

(b) a structure defining a passageway having an upstream end, a downstream end and a venturi section between its upstream and downstream ends, the downstream end of said passageway communicating with the upstream end of said connecting tube bore;

(c) means for connecting the upstream end of said passageway to a source of gas under pressure whereby gas received in said passageway from such source may flow downstream in said passageway and said connecting tube bore;

(d) means for confining any gas flowing downstream in said passageway into a constricted stream of cross-sectional area substantially less than the cross-sectional area of said connecting tube bore so that the constricted stream extends through said venturi section;

(e) blockage means for substantially preventing or permitting the escape of gas from the downstream end of said connecting tube bore in response to the phenomenon to be sensed; and (f) detector means for detecting the pressure within said venturi section of said passageway, producing a first output signal when such pressure is less than a predetermined trip pressure and producing a second output signal, different from said first output signal when the pressure within said venturi section is greater than said trip pressure, said structure including a block having a block bore formed therein and a hollow, tubular cannula extending into said block bore substantially coaxially therewith, said cannula defining the upstream portion of said passageway, the interior cross-sectional area of said cannula being substantially less than the cross-sectional area of said connecting tube bore, the interior of said cannula and the portion of said block bore immediately downstream of said cannula constituting the venturi section of said passageway, said confining means including said cannula, a portion of said block bore surrounding said cannula and defining a chamber which is in communication, at the downstream end of said cannula, with the venturi section of said passageway, said detector means being operatively connected to said venturi section by way of said chamber, said device further comprising:

a relief valve in communication with said chamber, said relief valve opening and releasing gas from said chamber when, and only when, the pressure within said chamber exceeds a predetermined relief pressure, said relief pressure being greater than said trip pressure.

4. A pneumatic remote sensing device comprising:

(a) a connecting tube defining a connecting tube bore having an upstream end and a downstream end;

(b) a structure defining a passageway having an upstream end, a downstream end and a venturi section between its upstream and downstream ends, the downstream end of said passageway communicating with the upstream end of said connecting tube bore;

(c) means for connecting the upstream end of said passageway to a source of gas under pressure whereby gas received in said passageway from such source may flow downstream in said passageway and said connecting tube bore;

(d) means for confining any gas flowing downstream in said passageway into a constricted stream of cross-sectional area substantially less than the cross-sectional area of said connecting tube bore so that the constricted stream extends through said venturi section;

(e) blockage means for substantially preventing or permitting the escape of gas from the downstream end of said connecting tube bore in response to the phenomenon to be sensed; and (f) detector means for detecting the pressure within said venturi section of said passageway, producing a first output signal when such pressure is less than a predetermined trip pressure and producing a second output signal, different from said first output signal when the pressure within said venturi section is greater than said trip pressure, said structure including a block having a block bore formed therein and a hollow, tubular cannula extending into said block bore substantially coaxially therewith, said cannula defining the upstream portion of said passageway, the interior cross-sectional area of said cannula being substantially less than the cross-sectional area of said connecting tube bore, the interior of said cannula and the portion of said block bore immediately downstream of said cannula constituting the venturi section of said passageway, said confining means including said cannula, said cannula having an interior diameter of about 0.024 inches and an exterior diameter of about 0.036 inches, the portion of said block bore immediately downstream of said cannula having an interior diameter of about 0.052 inches.

5. A pneumatic remote sensing device adapted for use with a machine having a fixed element and a moveable element which is moveable along a predetermined path of travel relative to said fixed element, said device comprising:

(a) a connecting tube defining a connecting tube bore having an upstream end and a downstream end;

(b) a structure defining a passageway having an upstream end, a downstream end and a venturi section between its upstream and downstream ends, the downstream end of said passageway communicating with the upstream end of said connecting tube bore;

(c) means for connecting the upstream end of said passageway to a source of gas under pressure whereby gas received in said passageway from such source may flow downstream in said passageway and said connecting tube bore;

(d) means for confining any gas flowing downstream in said passageway into a constricted stream of cross-sectional area substantially less than the cross-sectional area of said connecting tube bore so that the constricted stream extends through said venturi section;

(e) blockage means for substantially preventing or permitting the escape of gas from the downstream end of said connecting tube bore in response to the phenomenon to be sensed; and (f) detector means for detecting the pressure within said venturi section of said passageway and producing an output signal which is a function of such passage, said blockage means including a sensor block having an exposed surface and an orifice opening to said exposed surface, said orifice being connected to the downstream end of said connecting tube bore so that said orifice constitutes a downstream continuation of said connecting tube bore, said blockage means also including means for mounting said sensor block to the fixed element of the machine so that, when said movable element is at a predetermined point along said predetermined path of travel, a surface of the moveable element closely overlies said exposed surface of said sensor block and substantially occludes said orifice.

6. A device as claimed in claim 5, wherein said means for mounting said sensor block to said fixed element of said machine is operative to fixedly mount said sensor block to said fixed element of said machine so that said exposed surface of said sensor block extends across said predetermined path of travel, whereby said exposed surface will engage said movable element and arrest its travel substantially simultaneously with the occlusion of said orifice by said movable element.

7. A pneumatic remote sensing device comprising:

(a) a connecting tube defining a connecting tube bore having an upstream end and a downstream end;

(b) a structure defining a passageway having an upstream end, a downstream end and a venturi section between its upstream and downstream ends, the downstream end of said passageway communicating with the upstream end of said connecting tube bore;

(c) means for connecting the upstream end of said passageway to a source of gas under pressure whereby gas received in said passageway from such source may flow downstream in said passageway and said connecting tube bore;

(d) means for confining any gas flowing downstream in said passageway into a constricted stream of cross-sectional area substantially less than the cross-sectional area of said connecting tube bore so that the constricted stream extends through said venturi section;

(e) blockage means for substantially preventing or permitting the escape of gas from the downstream end of said connecting tube bore in response to the phenomenon to be sensed; and (f) detector means for detecting the pressure within said venturi section of said passageway and producing an output signal which is a function of such pressure, said blockage means including an encoder block defining a generally cylindrical shaft mounting bore and an orifice intersecting said shaft mounting bore and opening to the interior surface thereof, said orifice communicating with the downstream end of said connecting tube bore so that said orifice constitutes a downstream continuation of said connecting tube bore, said blockage means also including a shaft rotatably mounted in said shaft mounting bore and extending generally coaxially therewith, said shaft having, in the vicinity of said orifice, a generally arcuate surface which closely overlies the interior surface of said shaft mounting bore and a cutaway surface which is remote from the interior surface of said shaft mounting bore, whereby, upon rotation of said shaft, said arcuate surface and said cutaway surface will be successively aligned with said orifice.

8. A pneumatic remote sensing device comprising:

(a) a connecting tube defining a connecting tube bore having an upstream end and a downstream end;

(b) a structure defining a passageway having an upstream end, a downstream end and a venturi section between its upstream and downstream ends, the downstream end of said passageway communicating with the upstream end of said connecting tube bore;

(c) means for connecting the upstream end of said passageway to a source of gas under pressure whereby gas received in said passageway from such source may flow downstream in said passageway and said connecting tube bore;

(d) means for confining any gas flowing downstream in said passageway into a constricted stream of cross-sectional area substantially less than the cross-sectional area of said connecting tube bore so that the constricted stream extends through said venturi section;

(e) blockage means for substantially preventing or permitting the escape of gas from the downstream end of said connecting tube bore in response to the phenomenon to be sensed; and (f) detector means for detecting the pressure within said venturi section of said passageway and producing an output signal which is a function of such pressure, said blockage means including a generally helically wound coil spring, adjacent ones of the coils of said spring abutting one another to cooperatively define an interior bore when said spring is in an undistorted state, one end of said interior bore communicating with the downstream end of said connecting tube bore so that said interior bore constitutes a downstream continuation of said connecting tube bore, said blockage means also including a cap occluding the other end of said interior bore.

9. A component for use in a pneumatic remote sensing system, said component comprising a structure defining a plurality of passageways and a manifold, each such passageway having an upstream end directly connected to said manifold, a downstream end and a venturi section between such upstream end and such downstream end, said component also including means for confining any gas flowing downstream in each one of said passageways into a constricted stream extending through the venturi section of such passageway, said component further including detector means connected to each one of said passageways for detecting the pressure within the venturi section of such passageway and producing an output signal which is a function of such pressure, said structure including a block having a slot and a number of bores equal to the number of said passageways formed therein, said structure also including a cover plate overlying said slot, each one of said bores intersecting said slot at one end, each one of said passageways including at least a portion of one of said bores, said manifold including said slot.

10. A component as claimed in claim 9, wherein said structure includes a number of plugs equal to the number of said passageways and a number of tubular cannulae equal to the number of said passageways, each one of said plugs being positioned within one of said bores at its intersection with said slot, each one of said cannulae being affixed to one of said plugs so that each such cannula extends through the associated plug and defines the upstream portion of one of said passageways.

11. A device as claimed in claim 1 or claim 3 in which said trip pressure is about 2 in. $H_2O$ and said relief pressure is about 6 in. $H_2O$.

* * * * *

UNITED STATES PATENT AND TRADEMARK OFFICE

CERTIFICATE OF CORRECTION

PATENT NO. : 4,322,590
DATED : March 30, 1982
INVENTOR(S) : Martin Sobel

It is certified that error appears in the above—identified patent and that said Letters Patent is hereby corrected as shown below:

Column 1, line 37, "requite" should read --require--;

line 44, "accomodating" should read --accommodating--.

Column 3, line 16, "desireable" should read --desirable--.

Column 5, line 57, "baised" should read --biased--.

Column 8, line 18, "acurate" should read --arcuate--;

line 49, "form" should read --from--.

Signed and Sealed this

*Twenty-ninth* Day of *June 1982*

[SEAL]

*Attest:*

GERALD J. MOSSINGHOFF

*Attesting Officer* *Commissioner of Patents and Trademarks*